United States Patent [19]

Prescott

[11] Patent Number: 4,863,216

[45] Date of Patent: Sep. 5, 1989

[54] BABY CHAIR OF THE TYPE WHICH HOOKS ON A TABLE EDGE

[76] Inventor: Clovis H. Prescott, 445 Oakaview Road, S-13 C-11 R.R. #4, Kelowna, British Columbia, Canada, V1Y 7R3

[21] Appl. No.: 265,563

[22] Filed: Nov. 1, 1988

[51] Int. Cl.[4] ..... A47B 39/00

[52] U.S. Cl. ..... 297/174; 297/134

[58] Field of Search ..... 297/134, 174

[56] References Cited

U.S. PATENT DOCUMENTS

| | | | |
|---|---|---|---|
| 2,451,667 | 10/1943 | Ducey | 297/174 |
| 2,964,098 | 12/1960 | Towse . | |
| 3,059,965 | 10/1962 | Fornetti | 297/174 |
| 3,133,760 | 5/1964 | Robinson | 297/174 |
| 4,312,535 | 1/1982 | Smith | 297/174 |
| 4,322,110 | 3/1982 | Simmons et al. | 297/174 |
| 4,506,928 | 3/1985 | Marion . | |
| 4,568,120 | 2/1986 | Hoffman | 297/174 |
| 4,586,746 | 5/1986 | Day et al. | 297/174 |

FOREIGN PATENT DOCUMENTS

| | | | |
|---|---|---|---|
| 957265 | 11/1974 | Canada | 297/174 |

*Primary Examiner*—Peter R. Brown

*Attorney, Agent, or Firm*—Adrian D. Battison; Stanley G. Ade; Murray E. Thrift

[57] ABSTRACT

A baby chair of the type which can be attached to an edge of a table includes an upper rail which is U-shaped to define two forwardly projecting members which engage the table and a base of the U-shape which extends around the rear of a chair portion which is formed as a plastic molding suspended from the upper rail. The chair portion includes a pivotal back and also a pivotal foot rest portion both of which can be moved into a storage position confined within the dimensions of the chair sides. The forwardly extending rail portions each include a pivotal leg which can move to a position projecting downwardly from the underside of the rail together with an extension portion in the form of a sleeve which can be latched in a position extending outwardly from the end or can pivot upwardly about a horizontal axis. A lower rail portion is welded to the upper rail and extends downwardly adjacent the side of the seat and then forwardly under the table to engage the underside of the table between an outer edge of the extension portion and the leg so that the table is clamped between the three resilient contact points. The construction defines a very simple chair which can be simply but firmly attached to the table edge.

14 Claims, 3 Drawing Sheets

BABY CHAIR OF THE TYPE WHICH HOOKS ON A TABLE EDGE

BACKGROUND OF THE INVENTION

This invention relates to a baby chair of the type which can be suspended from an edge of a table without necessity for supporting legs.

Various designs of baby chairs of this type have previously been proposed and a search has revealed the following patents which show various arrangements: U.S. Pat. Nos.: 4,658,120 (Hoffman), 4,586,746 (Day), 4,312,535 (Smith) and 4,506,928 (Marion).

However none of these devices has been entirely satisfactory partly in view of the fact that they are relatively complicated in their construction and secondly in view of the inability of the device to simply but firmly latch onto table surfaces of different thicknesses and constructions.

One of the advantages of a device of this general type is that it is simple in construction, lightweight and of a relatively small dimensions. It will be appreciated therefore that a device of this type is often transported from place to place and must be attached to different table surfaces.

SUMMARY OF THE INVENTION

It is one object of the present invention therefore to provide an improved baby seat of this general type.

According to a first aspect of the invention, therefore, there is provided a baby chair of the type which is suspendible from an edge of a table comprising a chair portion having a chair bottom, chair sides and a chair back in which the child can sit, and a support section supporting the chair portion on the table edge, the support section comprising a pair of support members projecting forwardly from the chair portion at positions thereon adjacent the chair sides, each support member including an upper rail for engaging over an upper surface of the table and a lower rail for engaging an undersurface of the table, the lower rail having an upwardly projecting finger for engaging the undersurface at a first position thereon spaced from the edge, and the upper rail having a forward portion including on an underside thereof a resilient surface for engaging the upper surface at a second position spaced from the edge by a distance greater than the first position and a rearward portion including on an underside thereof a resilient surface separate from the forward portion for engaging the upper surface of the table at a third position spaced from the edge by a distance less than the first position, at least one of the forward and rearward portions of the upper rail being pivotally mounted so to be removable from an operative position to a release position in which the resilient surface thereof is moved away from the upper surface of the table.

According to a second aspect of the invention there is provided a baby chair of the type which is suspendible from an edge of a table comprising a chair portion having a chair bottom, chair sides and a chair back in which the child can sit, and a support section supporting the chair portion on the table edge, the support section comprising a pair of support members projecting forwardly from the chair portion at positions thereon adjacent the chair sides, each support member including an upper rail for engaging over an upper surface of the table and a lower rail for engaging an undersurface of the table, the lower rail having an upwardly projecting finger for engaging the undersurface at a first position thereon spaced from the edge, and the upper rail having a forward portion including on an underside thereof a resilient surface for engaging the upper surface at a second position spaced from the edge by a distance greater than the first position and a rearward portion including on an underside thereof a resilient surface separate from the forward portion for engaging the upper surface of the table at a third position spaced from the edge by a distance less than the first position, said support section comprising an integrally formed U-shaped member defining said upper rails on outstanding legs thereof with a base of the U-shape extending around the chair back and the lower rails connected to the single elongate member at an underside thereof so as to extend downwardly and forwardly therefrom, the chair portion comprising a molded plastics body suspended from the U-shape support section, and including a pair of upper flanges arranged to sit on a top surface of the U-shaped support section such that the chair sides and the chair bottom are supported from the U-shaped support section.

According to a third aspect of the invention there is provided A baby chair of the type which is suspendible from an edge of a table comprising a chair portion having a chair bottom, chair sides and a chair back in which the child can sit, and a support section supporting the chair portion on the table edge, the support section comprising a pair of support members projecting forwardly from the chair portion at positions thereon adjacent the chair sides, each support member including an upper rail for engaging over an upper surface of the table and a lower rail for engaging an undersurface of the table, the lower rail having an upwardly projecting finger for engaging the undersurface at a first position thereon spaced from the edge, and the upper rail having a forward portion including on an underside thereof a resilient surface for engaging the upper surface at a second position spaced from the edge by a distance greater than the first position and a rearward portion including on an underside thereof a resilient surface separate from the forward portion for engaging the upper surface of the table at a third position spaced from the edge by a distance less than the first position, a U-shaped foot rest member having a transverse base on which the feet of the child can rest and upstanding supporting sides pivotally mounted on the chair sides for movement from an operative position in which the transverse base lies beneath the forward edge of the seat portion to a folded position in which the transverse base is folded upwardly and inwardly to a position between the chair sides.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
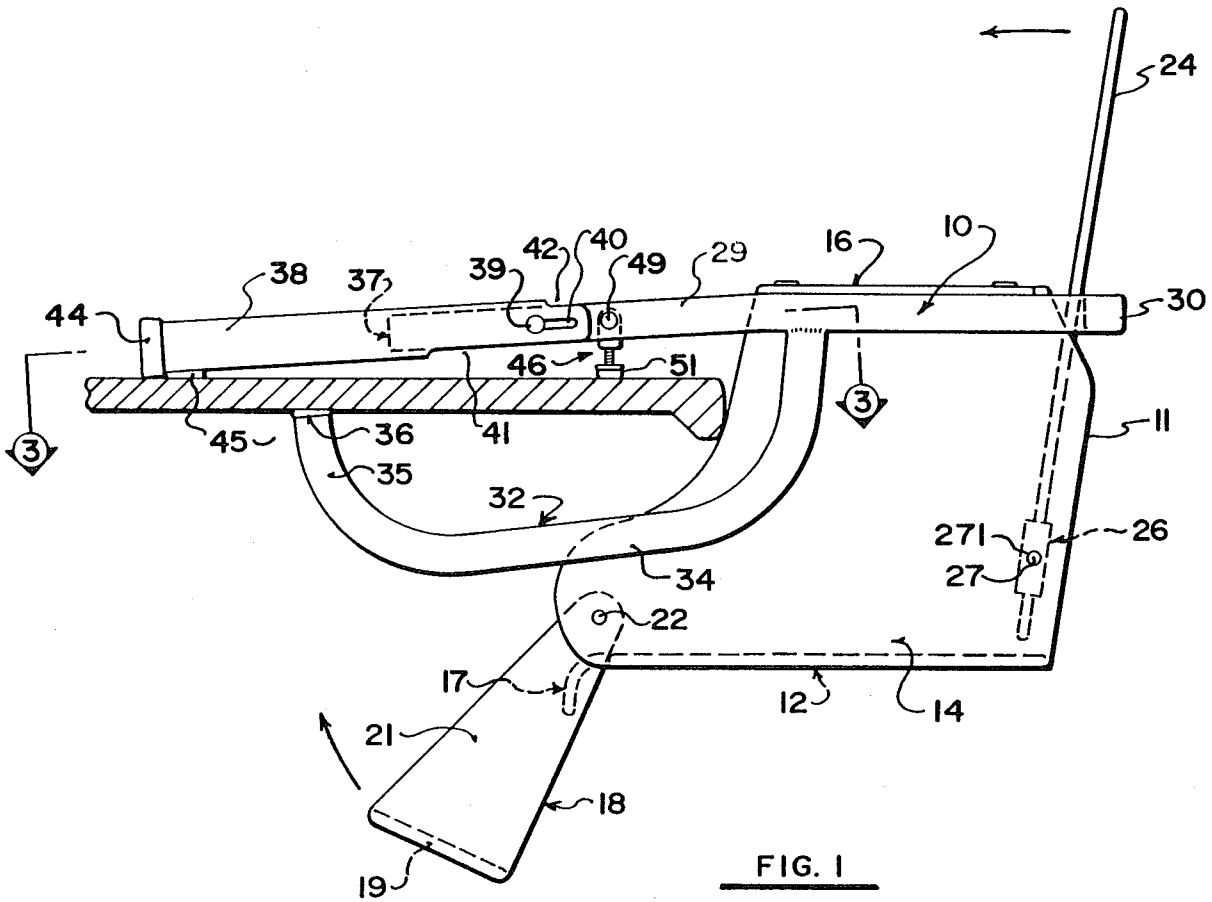
FIG. 1 is a side elevational view of a baby seat according to the invention mounted in position upon a table edge.

The chair shown in the figures comprises an upper support section 10 and a suspended chair portion 11. The chair portion 11 comprises a generally U-shaped molded section defining a chair bottom 12 and upstanding sides 13 and 14. Upper edges of the sides 13 and 14 are turned outwardly to form flanges 15 and 16 so that the flange sits on the upper surface of the square section tubular member forming the support rail 10. A rearward edge of the chair bottom 12 is substantially coterminous with rearward edges of the sides 13 and 14. A forward edge of the chair bottom turns downwardly at a flange 17 to provide a smoothly curved edge against which the legs of the child in the seat will rest. A forward edge of the sides 13 and 14 projects forwardly beyond the front face of the flange 17 so as to form tabs which can pivotally receive side edges of a foot rest portion 18. From the forwardmost edges of the sides 13 and 14 at the junction with the seat bottom, the four edges incline rearwardly and upwardly to smoothly join at a forward edge of the flange 15 and 16.

The foot rest portion 18 is formed by a U-shaped member having a horizontal transverse plate 19 on which the feet of the child will rest in use together with vertical sides 20 and 21 which support the transverse plate 19 and couple it to the tabs at the forward ends of the sides 13 and 14 for pivotal movement by the horizontal axis defined by pivot pins 22 and 23. In the operative position shown in FIG. 2, a rearward edge of the supporting sides 20 and 21 engages against a front side of the flange 17. In the folded position shown in FIG. 2, the foot rest portion is received within the area of the seat itself so that the complete device in the folded position has a dimension no greater than the size of the seat portion.

Figure 4:
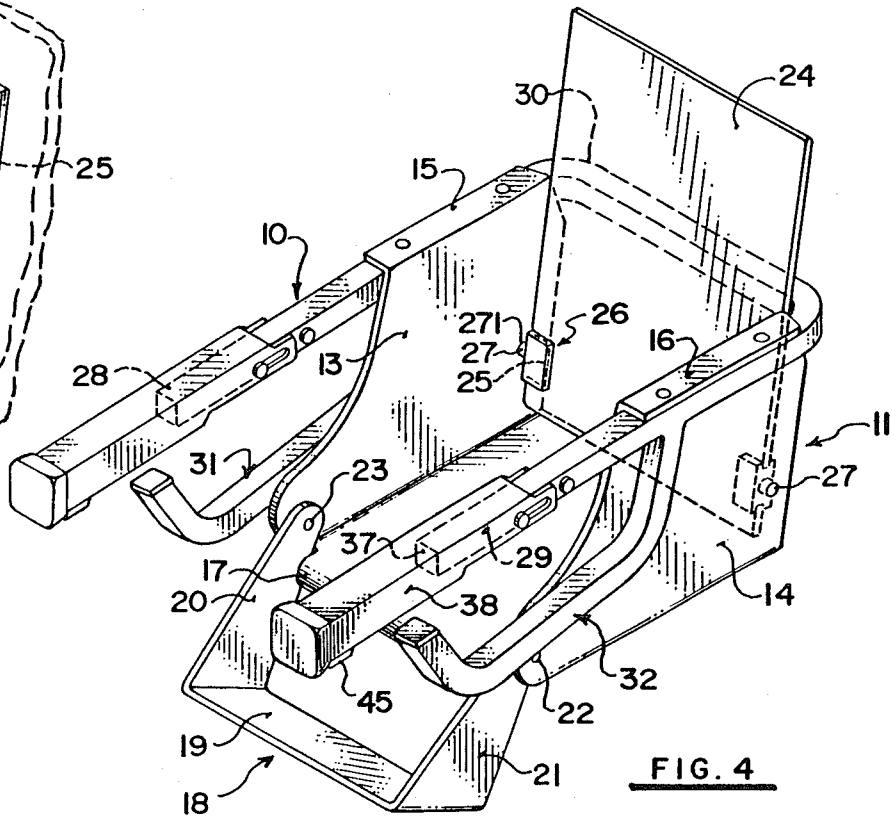
FIG. 4 is an isometric view of the chair with the latching portions of the upper rail omitted for convenience of illustration.
Figure 4A:
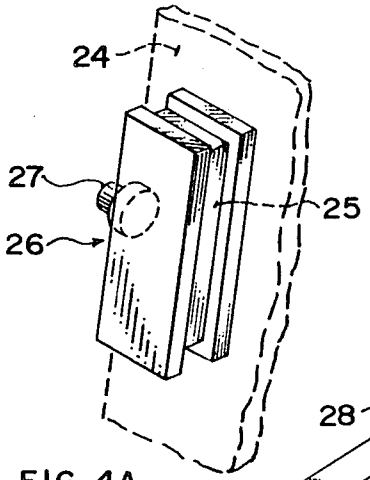
FIG. 4A is an enlarged isometric view of one portion of the chair back showing the chair hinge member.

The seat back is indicated at 24 and comprises basically a flat sheet of a size such that it can be received between the sides of the chair portion and extends upwardly effectively from the chair bottom to a position beyond the rail 10. The flat plate forming the seat back 24 has a pair of recesses 25 cut in the side edge thereof adjacent the bottom, only one of which is visible in FIG. 4. Into the recess is inserted a hinge member 26 in the form of a block which has slots on three sides so that the block can be inserted onto the side of the seat back with the slots cooperating with the edges of the recess 25 to hold the block in position with a portion on the front side of the seat back and a portion on the rear side. The block includes a peg 27 which projects outwardly from the side of the block in the direction opposite to the seat back so as to cooperate with a hole 271 in the chair side at a position spaced from the chair bottom. In this way the chair back is pivotal about an axis defined by the pegs 27 from the erected position shown in FIG. 1 to the folded position shown in FIG. 2 in which the seat back is received with the confines of the chair portion.

The support section or rail 10 comprises a square section tubular member formed of aluminum which is bent into a U-shape with parallel sides 28 and 29 and a connecting base 30 which runs around the rear of the chair portion and provides a support for the chair back in the erected condition. Each of the side rails 28 and 29 extends forwardly from the seat sides to form an upper rail of a support portion for engaging the table top. Each of the upper rails 28 and 29 has welded thereto a lower rail 31, 32. Thus the rail 32 is welded to the upper rail 29 at a point indicated at 33 which lies along the side of the chair and from that position the lower rail 32 extends downwardly and forwardly into a horizontal portion 34 which is bent at a forward end thereof into an upturned finger 35. On an upper edge of the finger 35 is provided a resilient rubber cap 36 which, when engaging the underside of the table top as shown in FIG. 1 provides some resilience relative thereto together with a frictional engagement which resists sliding action.

Figure 2:
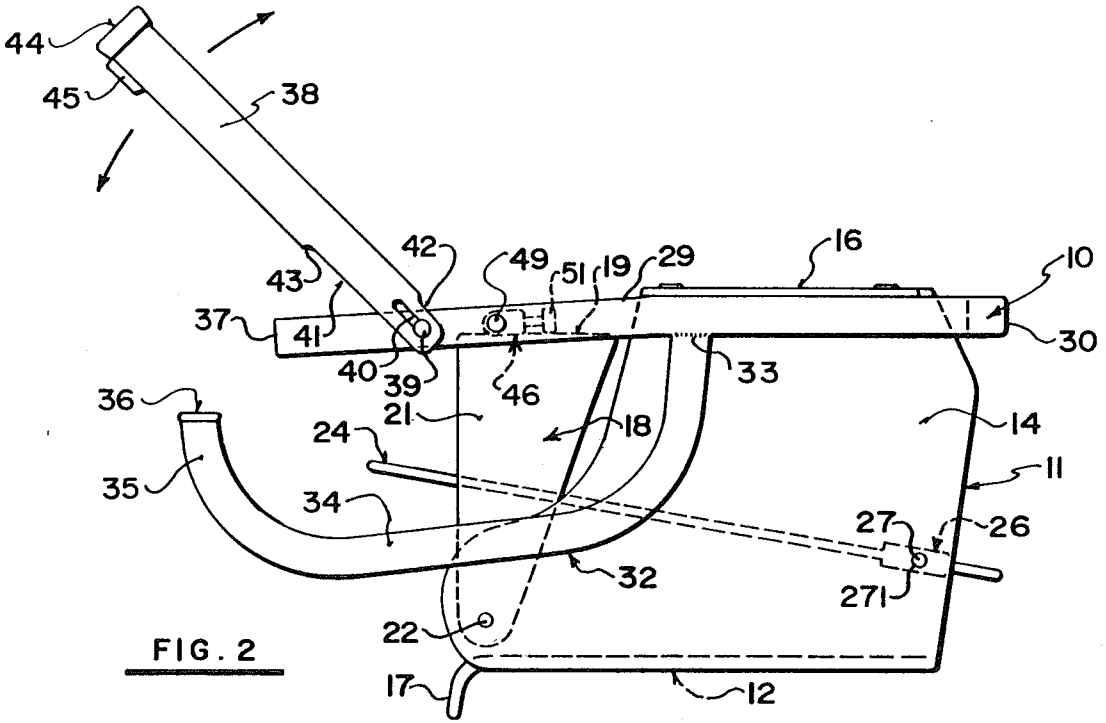
FIG. 2 is a similar side elevational view showing the chair with the seat back and foot rest portions in folded condition and with the latching portions of the upper rail moved from the operative position of FIG. 1.
Figure 3:
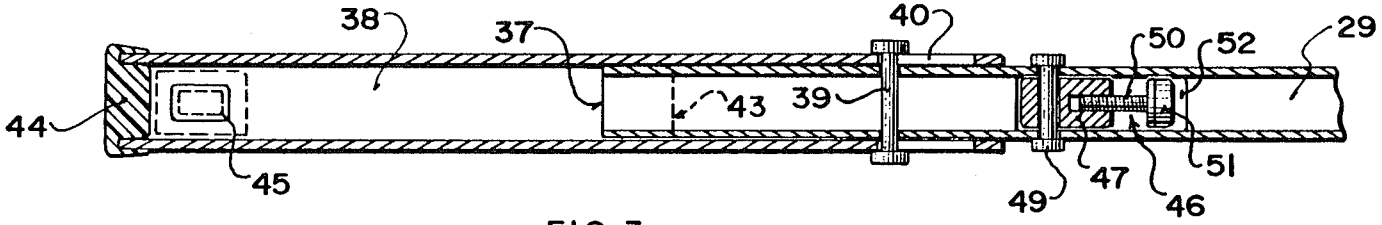
FIG. 3 is a cross sectional view along the lines 3—3 of FIG. 1.

As shown in FIGS. 1, 2 and 3, the upper rail 29 terminates at an end 37 forwardly on the seat side. On this forward end is connected a forward portion 38 of the upper rail which is shown in FIGS. 1 and 2 as pivotal relative to the horizontal upper rail 29. This pivotal movement is provided by a pair of pins 39 which project outwardly from the sides of the upper rail 29 and cooperate with a pair of slots 40 provided in the sides of the forward portions 38. The pin and slot coupling 39, 40 enables rotational movement of the forward portion around the pin and also forward and rear siding movement of the forward portion 38 on the rail 29.

The forward portion 38 is formed as a square cross section sleeve which is dimensioned so that it can slide over the outer surface of the rail 29. A portion 41 of the underside of the sleeve is removed at the rearward end of the forward portion 38. Similarly a shorter portion 42 of the upper wall of the forward portion 38 is removed again at the rearward end. As shown in FIG. 1, with the forward portion 38 slid rearwardly to its rearwardmost position, a lower edge 43 of the forward portion engages the end of the rail 29 to prevent upward pivotal movement and to lock the forward portion 38 as an extension of the rail 29. Forward sliding movement of the forward portion moves the edge 43 to a position beyond the end of the rail 29 so that it can then pivot in a clockwise direction relative to the pins 39. The forward end of the forward portion 38 is closed by a plug 44 which includes a projection portion 45 which extends downwardly from the underside of the forward portion 38 to engage the upper surface of the table as shown in FIG. 1.

A pivotal leg 46 is mounted on the upper rail 29 at a position spaced from the end of the forward portion 38. The pivotal leg includes a block 47 which is mounted for pivotal movement about a transverse pin 49 together with a threaded bolt 50 which can be adjusted relative to the block 47 by rotation of the bolt. The head of the bolt carries a resilient pad 51 again for engaging the upper surface of the table as shown in FIG. 1. The leg 46 can be stored within the body of the upper rail by pivotal movement in a counterclockwise direction into a slot 52 in the undersurface of the upper rail. Pivotal movement of the leg in a clockwise direction causes it to engage one end of the slot 52 thus holding the leg at a slightly over-center position.

In operation the baby chair can be transported from place to place with the back and the foot rest in the folded condition shown in FIG. 2. In addition during transportation the leg 46 will be in the stored position of FIG. 2 and maintain that position by friction at engagement with the inner surface of the upper rail 29. The forward portions 38 will normally take up the position shown in FIG. 1 under gravity.

When it is intended to apply the chair to the edge of the table, the foot rest is moved to the lowered position and the back 24 is lifted into the upright position. The forward portion 38 is moved to the raised position so that the chair can be pivoted through a small angle in a counterclockwise direction relative to its position in FIG. 1 and moved forwardly so that the upper rail moves along the upper surface of the table while the lower rail and its finger 35 moves along the underside of the table. When the edge of the table engages the front edge of the sides of the seat, forward movement is halted and the forward portion 38 of the upper rail is lowered and moved rearwardly into the latched position. At this time, the leg is moved in the clockwise direction to its lowered position by the operator, while the operator lifts the chair back. It will be noted that the projection 45 engaging the upper surface of the table is spaced outwardly from the end of the finger 35 which is in turn spaced outwardly from the lower end of the leg 46 so that the three points of contact provide a stable engagement of the device on the table. The height of the leg 46 can be adjusted in dependence upon the thickness of the table so that there is a slight tensioning of the resilient surfaces defining the contact points. The pivotal movement of the leg 46 is arranged to be slightly greater than 90° so that in the position shown in FIG. 1 the leg is slightly overcenter and is maintained in the overcenter condition by the slight tension defined by the three contact points.

Furthermore, any tendency of the chair to move away from the table edge causes the leg to press more firmly against the upper surface of the table and thus to resist that movement. Thus the leg acts as a locking mechanism acting to hold the chair in place with no possibility of working loose, even, should the child bounce the chair vigorously.

When it is required to remove the chair, the back of the chair is lifted to allow the operator to manually pivot the legs away from the locking position to the stored position. At this time the forward portion is again moved outwardly away from the chair until it is released from its latched position so that it can pivot upwardly to again fully release the chair from the table top. The chair can thus be pivoted again in a slightly counterclockwise direction and moved outwardly away from the edge of the table.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A baby chair of the type which is suspendible from an edge of a table comprising a chair portion having a chair bottom, chair sides and a chair back in which the child can sit, and a support section supporting the chair portion on the table edge, the support section comprising a pair of support members projecting forwardly from the chair portion at positions thereon adjacent the chair sides, each support member including an upper rail for engaging over an upper surface of the table and a lower rail for engaging an undersurface of the table, the lower rail having an upwardly projecting finger for engaging the undersurface at a first position thereon spaced from the edge, and the upper rail having a forward portion including on an underside thereof a first resilient surface for engaging the upper surface at a second position spaced from the edge by a distance greater than that of the first position and a rearward portion including on an underside thereof a second resilient surface separate from the first resilient surface of the forward portion for engaging the upper surface of the table at a third position spaced from the edge by a distance less than that of the first position, the forward portion of the upper rail being pivotally mounted on the rearward portion, which is fixed relative to said chair portion, about a horizontal axis transverse to said rearward portion and arranged on the rearward portion at a position forwardly of said second resilient surface such that the forward portion can be locked in an operative position extending directly longitudinal of the rearward portion and can be released from said operative position so to be removable from said operative position to a release position in which the first resilient surface thereof is moved away from the upper surface of the table.

2. The invention according to claim 1 wherein the forward portion comprises a sleeve member which can be received over a forward end of the rearward portion and is retained thereon by a pin coupling which allows sliding movement of the forward portion along the rearward portion, the forward portion being latched into the operative position by sliding a portion of the sleeve member thereof over the end of the rearward portion and can be released from the operative position by moving the portion away from the end of the rearward portion so that the forward portion can be pivoted on said pin coupling.

3. The invention according to claim 1 wherein the support section comprises a U-shaped member defining said support portions on outstanding legs thereof with a base of the U-shape extending around the chair back.

4. The invention according to claim 3 wherein the U-shaped support section is formed from tubular metal.

5. The invention according to claim 3 wherein the upper rails and the base of the U-shape around the back of the chair portion are formed integrally from a elongate member and wherein the lower rails are connected to the single elongate member at an underside thereof at a position thereon rearwardly of said horizontal axis and extend downwardly and forwardly therefrom.

6. The invention according to claim 3 wherein the chair portion comprises a molded plastics body suspended from the U-shape support section.

7. The invention according to claim 6 wherein the molded plastics body defines said sides and said bottom and a pair of upper flanges arranged to sit on a top surface of the U-shaped support section such that the sides and the bottom are supported from the U-shaped support section.

8. The invention according to claim 11 wherein the chair back comprises a member separate from the sides and bottom and includes a pair of projecting members extending outwardly to the sides thereof, the projecting members engaging the chair sides such that the back is pivotal about an axis defined by said projecting members from a first folded position in which the back lies forwardly to a position beneath the support section to an operative position in which the chair back rests against the base of the U-shaped support section.

9. The invention according to claim 7 including a U-shaped foot rest member having a transverse base on which the feet of the child can rest and upstanding supporting sides pivotally mounted on the chair sides for movement from an operative position in which the transverse base lies beneath the forward edge of the seat portion to a folded position in which the transverse base is folded upwardly and inwardly to a position between the chair sides.

10. A baby chair of the type which is suspendible from an edge of a table comprising a chair portion having a chair bottom, chair sides and a chair back in which the child can sit, and a support section supporting the chair portion on the table edge, the support section comprising a pair of support members projecting forwardly from the chair portion at positions thereon adjacent the chair sides, each support member including an upper rail for engaging over an upper surface of the table and a lower rail for engaging an undersurface of the table, the lower rail having an upwardly projecting finger for engaging the undersurface at a first position thereon spaced from the edge, and the upper rail having a forward portion including on an underside thereof a first resilient surface for engaging the upper surface at a second position spaced from the edge by a distance greater than that of the first position and a rearward portion including on an underside thereof a second resilient surface separate from the first resilient surface of the forward portion for engaging the upper surface of the table at a third position spaced from the edge by a distance less than that of the first position, wherein the rearward portion carries a leg including said second resilient surface on a lower end thereof mounted on the upper rail for pivotal movement about a substantially horizontal axis from a first operative position in which the leg projects downwardly for engagement of the second resilient surface with the upper surface of the table and to hold the rail away from the upper surface and is prevented from pivoting in a direction toward the forward end of the rail, to a retracted position in which the leg pivots in a direction away from the forward end of the rail to a position in which it lies substantially parallel with the upper rail.

11. The invention according to claim 10 wherein the leg in the retracted position is received within a slot in the upper rail.

12. The invention according to claim 10 including means for adjusting the length of the leg.

13. A baby chair of the type which is suspendible from an edge of a table comprising a chair portion having a chair bottom, chair sides and a chair back in which the child can sit, and a support section supporting the chair portion on the table edge, the support section comprising a pair of support members projecting forwardly from the chair portion at positions thereon adjacent the chair sides, each support member including an upper rail for engaging over an upper surface of the table and a lower rail for engaging an undersurface of the table, the lower rail having an upwardly projecting finger for engaging the undersurface at a first position thereon spaced from the edge, and the upper rail having a forward portion including on an underside thereof a first resilient surface for engaging the upper surface at a second position spaced from the edge by a distance greater than that of the first position and a rearward portion including on an underside thereof a second resilient surface separate from the forward portion for engaging the upper surface of the table at a third position spaced from the edge by a distance less than that of the first position, said support section comprising an integrally formed U-shaped member defining said upper rails on outstanding legs thereof with a base of the U-shape extending around the chair back and the lower rails connected to the single elongate member at an underside thereof so as to extend downwardly and forwardly therefrom, the chair portion comprising a molded plastics body suspended from the U-shape support section, and including a pair of upper flanges arranged to sit on a top surface of the U-shaped support section such that the chair sides and the chair bottom are supported from the U-shaped support section.

14. The invention according to claim 13 wherein the chair back comprises a member separate from the sides and bottom and includes a pair of projecting members extending outwardly to the sides thereof, the projecting members engaging the chair sides such that the back is pivotal about an axis defined by said projecting members from a first folded position in which the back lies forwardly to a position beneath the support section to an operative position in which the chair back rests against the base of the U-shaped support section.

* * * * *